US011011130B2

(12) United States Patent
Morita

(10) Patent No.: US 11,011,130 B2
(45) Date of Patent: May 18, 2021

(54) CIRCUIT DEVICE, ELECTRO-OPTICAL DEVICE, AND ELECTRONIC APPARATUS HAVING PLURAL CAPACITOR ELEMENTS

(71) Applicant: SEIKO EPSON CORPORATION, Tokyo (JP)

(72) Inventor: Akira Morita, Chino (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 16/524,242

(22) Filed: Jul. 29, 2019

(65) Prior Publication Data

US 2020/0035190 A1 Jan. 30, 2020

(30) Foreign Application Priority Data

Jul. 30, 2018 (JP) ..... JP2018-142162

(51) Int. Cl.
*G09G 3/36* (2006.01)
*G09G 3/20* (2006.01)

(52) U.S. Cl.
CPC ..... *G09G 3/3696* (2013.01); *G09G 3/2092* (2013.01); *G09G 3/3688* (2013.01); *G09G 2310/027* (2013.01); *G09G 2310/0248* (2013.01); *G09G 2310/0291* (2013.01)

(58) Field of Classification Search
CPC .. G09G 3/2092; G09G 3/3696; G09G 3/3275; G09G 2310/027; G09G 3/3688; G09G 2310/0248; G09G 2310/0291
See application file for complete search history.

(56) References Cited

U.S. PATENT DOCUMENTS

2011/0205481 A1* 8/2011 Aruga ..... G09G 3/3648 349/151
2016/0111038 A1 4/2016 Morita
2016/0133218 A1* 5/2016 Morita ..... G09G 3/3696 345/213
2018/0226047 A1 8/2018 Morita

FOREIGN PATENT DOCUMENTS

JP S62-104067 A 5/1987
JP 2012-142497 A 7/2012
JP 2016-080805 A 5/2016
JP 2016-090881 A 5/2016

* cited by examiner

*Primary Examiner* — Xuemei Zheng
(74) *Attorney, Agent, or Firm* — Oliff PLC

(57) ABSTRACT

A circuit device includes a driving circuit and an output capacitor. The output capacitor includes a first MIM capacitor element including a first metal layer, a second metal layer, and a first insulating layer, and a second MIM capacitor element including a third metal layer, a fourth metal layer, and a second insulating layer. The first metal layer and the fourth metal layer are electrically coupled to the capacitor drive node, and the second metal layer and the third metal layer are electrically coupled to the voltage output node. The second metal layer is positioned at the third metal layer side with respect to the first metal layer, and the third metal layer is positioned at the second metal layer side with respect to the fourth metal layer.

14 Claims, 13 Drawing Sheets

CIRCUIT DEVICE, ELECTRO-OPTICAL DEVICE, AND ELECTRONIC APPARATUS HAVING PLURAL CAPACITOR ELEMENTS

The present application is based on, and claims priority from JP Application Serial Number 2018-142162, filed Jul. 30, 2018, the disclosure of which is hereby incorporated by reference herein in its entirety.

BACKGROUND

1. Technical Field

The present disclosure relates to a circuit device, an electro-optical device, and an electronic apparatus.

2. Related Art

Display devices are increasingly becoming higher in definition, and thus, a time period available for a driver to drive each pixel is shortened. As a technique for accelerating driving of pixels, there is a technique in which an electro-optical panel is driven by the charge redistribution of the capacitor. For example, JP-A-2016-080805 discloses a display driver including a capacitor driving circuit and a capacitor circuit. The capacitor driving circuit outputs voltage based on gradation data to the capacitor circuit to cause charge redistribution between the capacitor circuit and the electro-optical panel side capacitance. As a result of the charge redistribution, data voltages are written into the pixels. JP-A-2016-090881 discloses a display driver including a D/A converter circuit, an amplifier circuit, an auxiliary capacitor driving circuit, and an auxiliary capacitor circuit. The amplifier circuit drives an electro-optical panel based on the output voltage of the D/A converter circuit. Then, the auxiliary capacitor driving circuit outputs voltage based on gradation data to the auxiliary capacitor circuit, as a result of which charge redistribution is caused between the auxiliary capacitor circuit and the parasitic capacitance of the output node of the D/A converter circuit. The charge redistribution allows rapid changes of the output voltage of the D/A converter circuit.

When the voltage is output using the charge redistribution of the capacitor as described above, the parasitic capacitance of the node to which the voltage is output results in deviation in capacitance of the capacitor. The deviation in capacitance of the capacitor leads to a deviation in the distribution ratio in the charge redistribution, causing the deviation in the output voltage by the charge redistribution. In order to implement the above described capacitor in an integrated circuit, a single-layer capacitor has been employed in the related art. For example, the lower layer of the single-layer capacitor is coupled to the capacitor driving circuit, and the upper layer of the single layer capacitor is used as an output node. However, parasitic capacitance may be formed between the upper layer of the single-layer capacitor and another metal layer or the like. For example, since the upper layer of the single-layer capacitor is not necessarily the top-most layer, parasitic capacitance may occur between the upper layer of the single-layer capacitor and a wiring layer disposed above the upper layer of the single-layer capacitor.

SUMMARY

An aspect of the present disclosure relates to a circuit device including a driving circuit configured to output a capacitor drive voltage to a capacitor drive node, and an output capacitor, one end of the output capacitor being electrically coupled to the capacitor drive node and the other end of the output capacitor being electrically coupled to a voltage output node. In the circuit device, the output capacitor includes a first MIM capacitor element including a first metal layer, a second metal layer, and a first insulating layer provided between the first metal layer and the second metal layer and a second MIM capacitor element including a third metal layer, a fourth metal layer, and a second insulating layer provided between the third metal layer and the fourth metal layer. Further, in the circuit device, the first metal layer and the fourth metal layer are electrically coupled to the capacitor drive node, the second metal layer and the third metal layer are electrically coupled to the voltage output node, the second metal layer is positioned at the third metal layer side with respect to the first metal layer, and the third metal layer is positioned at the second metal layer side with respect to the fourth metal layer.

DESCRIPTION OF EXEMPLARY EMBODIMENTS

A preferable embodiment of the present disclosure will be described in detail hereinafter. Note that the embodiment described hereinafter is not intended to unjustly limit the content of the present disclosure as set forth in the claims, and all of the configurations described in the embodiments are not always required to solve the issues described in the present disclosure.

1. First Configuration Example

Figure 1:
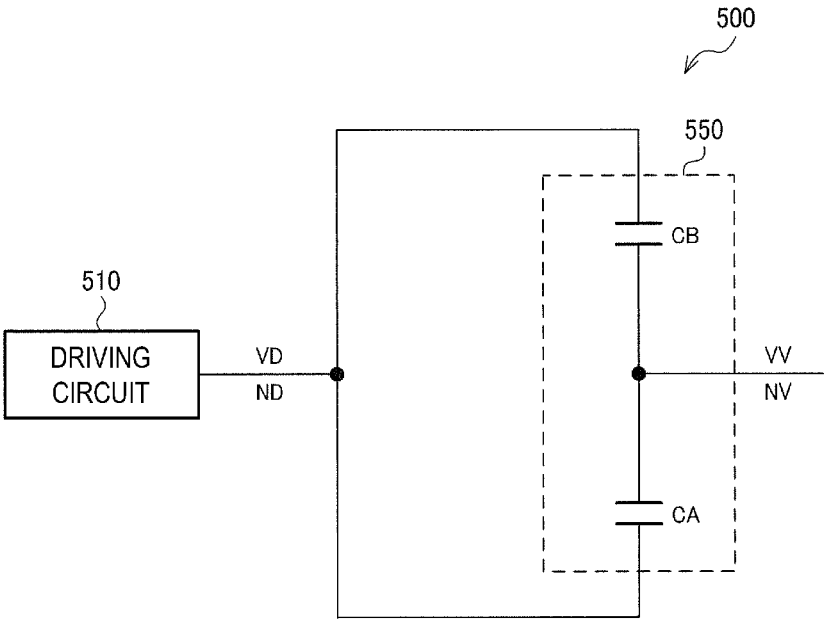
FIG. 1 is a block diagram illustrating a first configuration example of a circuit device.
Figure 2:
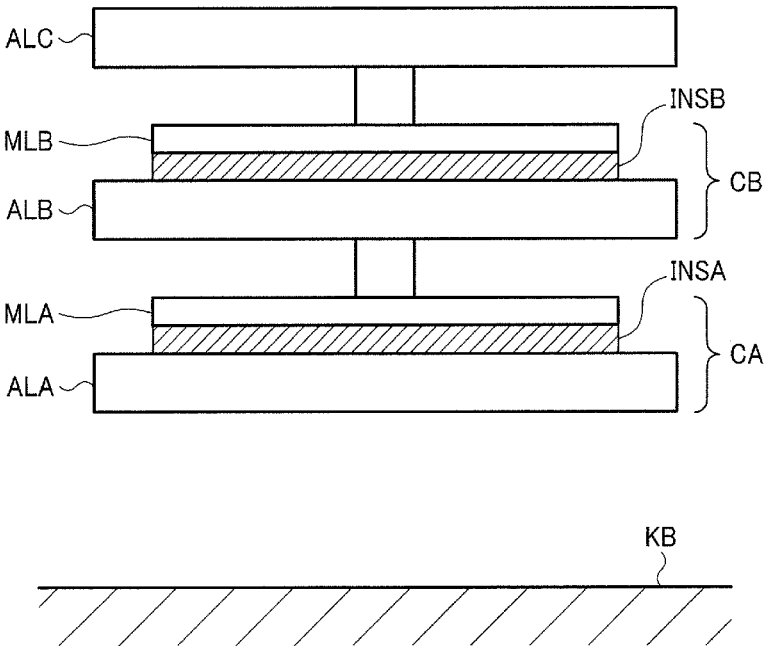
FIG. 2 is a cross-sectional view illustrating the structure of a capacitor in the first configuration example.

FIG. 1 is a block diagram illustrating a first configuration example of a circuit device 500. FIG. 2 is a cross-sectional view illustrating the structure of a capacitor in the first configuration example. The circuit device 500 is, for example, an integrated circuit device. In the following, "the upper direction" is the thickness direction of a substrate KB and the direction away from the substrate KB in FIG. 2.

As illustrated in FIG. 1, the circuit device 500 includes a driving circuit 510 configured to output a capacitor drive voltage VD to a capacitor drive node ND, and an output capacitor 550 provided between the capacitor drive node ND and a voltage output node NV.

The driving circuit 510 outputs any of a plurality of discrete voltages as the capacitor drive voltage VD. Alternatively, the driving circuit 510 may continuously output varying voltage as the capacitor drive voltage VD. The driving circuit 510 is, for example, a buffer circuit, an amplifier circuit, or the like. Data for setting the capacitor drive voltage VD is input to the driving circuit 510, and the driving circuit 510 outputs a capacitor drive voltage VD corresponding to the data. For example, when the circuit device 500 is a display driver, gradation data is input to the driving circuit 510.

The output capacitor 550 includes a first Metal Insulator Metal (MIM) capacitor element CA and a second MIM capacitor element CB. These MIM capacitor elements are coupled in parallel. In other words, one end of the first MIM capacitor element CA and one end of the second MIM capacitor element CB are coupled to the capacitor drive node ND, and the other end of the first MIM capacitor element CA and the other end of the second MIM capacitor element CB are coupled to the voltage output node NV.

As illustrated in FIG. 2, the first MIM capacitor element CA includes a first metal layer ALA, a second metal layer MLA, and a first insulating layer INSA. The second metal layer MLA is disposed above the first metal layer ALA. The first insulating layer INSA is provided between the first metal layer ALA and the second metal layer MLA. The second MIM capacitor element CB includes a third metal layer ALB, a fourth metal layer MLB, and a second insulating layer INSB. The fourth metal layer MLB is disposed above the third metal layer ALB. The second insulating layer INSB is provided between the third metal layer ALB and the fourth metal layer MLB.

The metal layers ALA and ALB are metal wiring layers for forming wiring between circuit elements, and are aluminum layers, for example. The metal layers MLA and MLB are metal layers for forming the upper layer side electrode of the MIM capacitor, and are aluminum layers, for example. The insulating layers INSA and INSB are layers for establishing insulation between the metal layers, and are silicon oxide layers, for example. The metal layers ALA, ALB, MLA, MLB and the insulating layers INSA and INSB are stacked on the substrate KB by a semiconductor process. Note that the metal layer ALA is not limited to the bottommost wiring layer, and a wiring layer may be further formed below the metal layer ALA.

The first metal layer ALA and the fourth metal layer MLB are electrically coupled to the capacitor drive node ND. Further, the second metal layer MLA and the third metal layer ALB are electrically coupled to the voltage output node NV. Specifically, a fifth metal layer ALC is provided above the fourth metal layer MLB, and the fifth metal layer ALC is coupled to the capacitor drive node ND. Further, the fifth metal layer ALC and the fourth metal layer MLB are coupled by a contact. The fifth metal layer ALC is a metal wiring layer for forming wiring between circuit elements. The third metal layer ALB is coupled to the voltage output node NV, and the second metal layer MLA and the third metal layer ALB are coupled by a contact. The contact is configured to establish conductive connection between the metal layers, and is formed by filling a hole provided on an insulating layer with metal. The contact is, for example, a tungsten contact.

The circuit device 500 outputs an output voltage VV to the voltage output node NV as follows. Namely, a capacitor as a circuit element, a capacitance equivalently included in a circuit element, or the like is coupled to the voltage output node NV. For example, when the circuit device 500 is a display driver, pixel capacitance or the like is coupled to the voltage output node NV. The capacitance to be coupled to the voltage output node NV is referred to as CNV. As the driving circuit 510 changes the capacitor drive voltage VD, charge redistribution occurs between the output capacitor 550 and the capacitance CNV, thus the output voltage VV changes. The output voltage VV is the voltage of the voltage output node NV.

At this time, when there is a deviation in the capacitance value of the capacitance CNV, the circuit device 500 cannot output the accurate output voltage VV. For example, the output capacitor 550 includes a single layer MIM capacitor element instead of the two layer MIM capacitor elements as illustrated in FIG. 2, is assumed. When the voltage output node NV is coupled to the upper metal layer of the two metal layers included in the single layer MIM capacitor element, parasitic capacitance occurs in the voltage output node NV by coupling between that metal layer and a metal layer that is positioned above that metal layer. The parasitic capacitance results in a deviation in the capacitance value of the capacitance CNV.

At this point, according to the embodiment, the first MIM capacitor element CA is configured by the second metal layer MLA to be coupled to the voltage output node NV and the first metal layer ALA provided below the second metal layer MLA. Further, the second MIM capacitor element CB is configured by the third metal layer ALB to be coupled to the voltage output node NV and the fourth metal layer MLB provided above the third metal layer ALB. In other words, the metal layers MLA and ALB to be coupled to the voltage output node NV are configured to be shielded by the metal layers ALA and MLB. As a result, formation of the capacitive coupling in relation to the metal layers MLA and ALB to be coupled to the voltage output node NV is suppressed, thus the parasitic capacitance in the voltage output node NV is reduced. Therefore, accurate charge redistribution can be achieved between the output capacitor 550 and the capacitance CNV, and thus, the circuit device 500 can output the accurate output voltage VV to the voltage output node NV.

Further, according to the embodiment, the second MIM capacitor element CB is stacked on the first MIM capacitor element CA. Since the first MIM capacitor element CA and the second MIM capacitor element CB are coupled in parallel, the capacitance value of the output capacitor 550 is the sum of the capacitance values of the two MIM capacitor elements CA and CB. As a result, the area of the output capacitor 550 can be reduced in plan view in the thickness direction of the substrate KB.

In addition, according to the embodiment, the use of the MIM capacitor allows reduction of the layout area of the output capacitor 550 and an accurate capacitance value of the output capacitor 550. Since the film thickness of the insulating layer in the MIM capacitor is thin, the capacitance value per unit area can be increased compared to when a capacitor between wiring layers or the like is used. Therefore, the layout area is reduced by using a MIM capacitor. In addition, compared to capacitors between the wiring layers, the film thickness of the insulating layer in the MIM capacitor is more easily controlled. As a result, the output capacitor 550 having an accurate capacitance value can be realized.

In the embodiment, the first MIM capacitor element CA and the second MIM capacitor element CB are arranged to be overlapped in plan view in the thickness direction of the substrate KB. In plan view, the areas of the second metal layer MLA and the fourth metal layer MLB are the same, and the entirety of the second metal layer MLA and the entirety of the fourth metal layer MLB are arranged to be overlapped.

As a result, the capacitance values of the first MIM capacitor element CA and the second MIM capacitor element CB are equal, thus the capacitance value of the output capacitor 550 is twice the capacitance value of a single layer MIM capacitor element. In other words, in order to provide a certain capacitance value, an area required by the output capacitor 550 is half the area required by a single layer MIM capacitor element. For example, when the capacitance value of the capacitance CNV driven by the output voltage VV is large, the capacitance value of the output capacitor 550 needs to be large. According to the embodiment, the area of the output capacitor 550 can be halved as compared to when a single layer MIM capacitor element is used, thus the layout area can be reduced even when a large capacitance value is required.

2. Second Configuration Example

Figure 3:
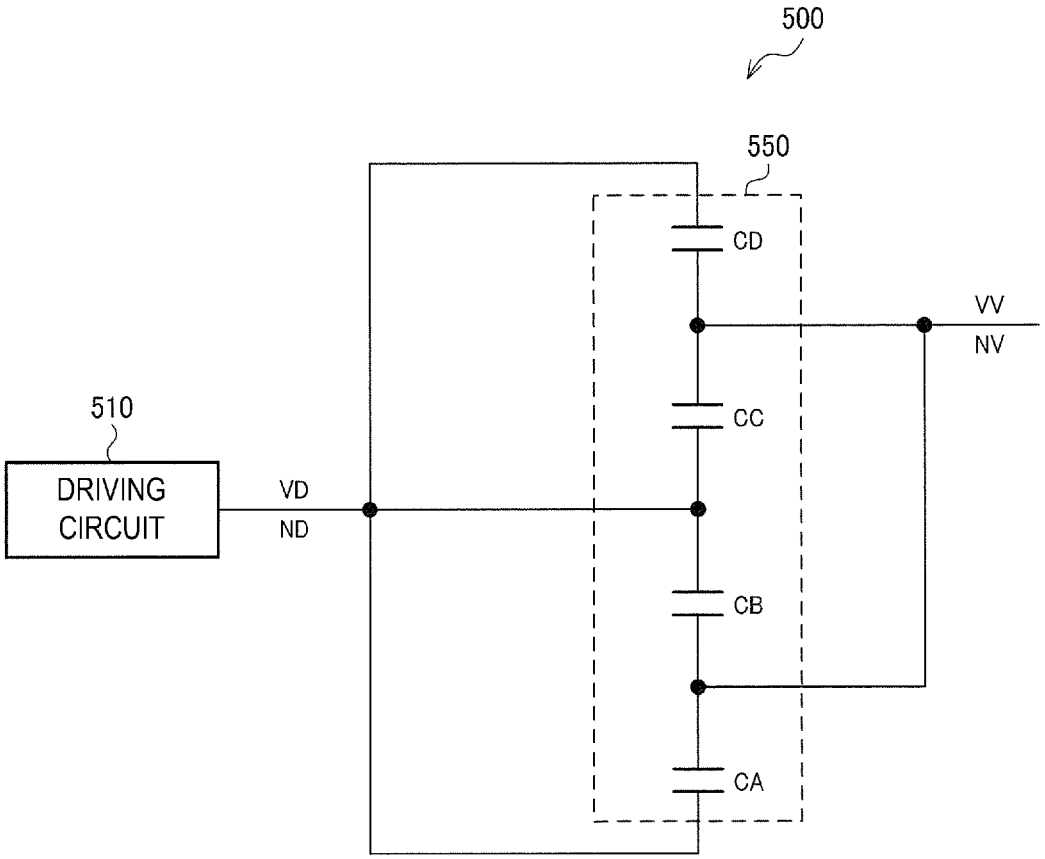
FIG. 3 is a block diagram illustrating a second configuration example of the circuit device.
Figure 4:
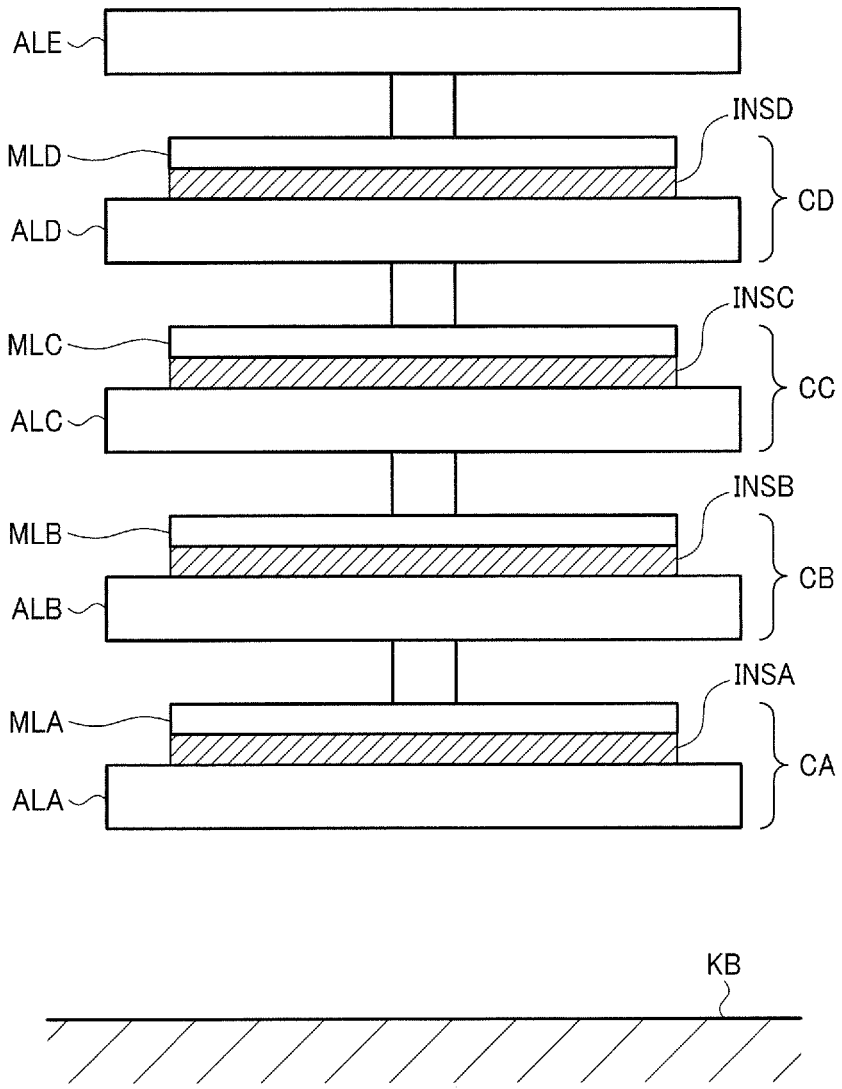
FIG. 4 is a cross-sectional view illustrating the structure of a capacitor in the second configuration example.

FIG. 3 is a block diagram illustrating a second configuration example of the circuit device 500. Further, FIG. 4 is a cross-sectional view illustrating the structure of a capacitor in the second configuration example. In the following, "the upper direction" is the thickness direction of the substrate KB and the direction away from the substrate KB in FIG. 4. Note that the components that are the same as the components described in connection with FIGS. 1 and 2 are referenced using like numbers, and descriptions for such components will be omitted as appropriate.

As illustrated in FIG. 3, the output capacitor 550 includes first to fourth MIM capacitor elements CA to CD. The third MIM capacitor element CC and the fourth MIM capacitor element CD are coupled in parallel. In other words, one end of the third MIM capacitor element CC and one end of the fourth MIM capacitor element CD are coupled to the capacitor drive node ND, and the other end of the third MIM capacitor element CC and the other end of the fourth MIM capacitor element CD are coupled to the voltage output node NV.

As illustrated in FIG. 4, the third MIM capacitor element CC includes a fifth metal layer ALC, a sixth metal layer MLC, and a third insulating layer INSC. The sixth metal layer MLC is disposed above the fifth metal layer ALC. The third insulating layer INSC is provided between the fifth metal layer ALC and the sixth metal layer MLC. The fourth MIM capacitor element CD includes a seventh metal layer ALD, an eighth metal layer MLD, and a fourth insulating layer INSD. The eighth metal layer MLD is disposed above the seventh metal layer ALD. The fourth insulating layer INSD is provided between the seventh metal layer ALD and the eighth metal layer MLD.

The metal layers ALC and ALD are metal wiring layers for forming wiring between circuit elements, and are aluminum layers, for example. The metal layers MLC and MLD are metal layers for forming upper layer side electrodes of the MIM capacitors, and are aluminum layers, for example. The insulating layers INSC and INSD are layers for establishing insulation between the metal layers, and are silicon oxide layers, for example. The metal layers ALC, ALD, MLC, and MLD and the insulating layers INSC and INSD are stacked on the substrate KB by a semiconductor process.

The fifth metal layer ALC and the eighth metal layer MLD are electrically coupled to the capacitor drive node ND. The sixth metal layer MLC and the seventh metal layer ALD are electrically coupled to the voltage output node NV. Specifically, a ninth metal layer ALE is provided above the eighth metal layer MLD, and the ninth metal layer ALE is coupled to the capacitor drive node ND. Further, the ninth metal layer ALE and the eighth metal layer MLD are coupled by a contact. The ninth metal layer ALE is a metal wiring layer for forming wiring between circuit elements. The seventh metal layer ALD is coupled to the voltage output node NV, and the sixth metal layer MLC and the seventh metal layer ALD are coupled by a contact.

According to the embodiment, the metal layers MLC and ALD to be coupled to the voltage output node NV are configured to be shielded by the metal layers ALC and MLD. Further, similar to the first configuration example, the metal layers MLA and ALB to be coupled to the voltage output node NV are configured to be shielded by the metal layers ALA and MLB. As a result, formation of the capacitive coupling in relation to the metal layers MLC, ALD, MLA and ALB to be coupled to the voltage output node NV is suppressed, and thus, the parasitic capacitance in the voltage output node NV is reduced. Therefore, accurate charge redistribution can be achieved between the output capacitor 550 and the capacitance CNV, thus the circuit device 500 can output the accurate output voltage VV to the voltage output node NV.

Further, according to the embodiment, the first to fourth MIM capacitor elements CA to CD are arranged to be overlapped in plan view in the thickness direction of the substrate KB. Since the first to fourth MIM capacitor elements CA to CD are coupled in parallel, the capacitance value of the output capacitor 550 is the sum of the capacitance values of the four MIM capacitor elements CA to CD. As a result, the area of the output capacitor 550 can be reduced in plan view in the thickness direction of the substrate KB. In other words, it is possible to reduce the area of the output capacitor 550 to ¼ compared to when the output capacitor 550 includes a single layer MIM capacitor element.

3. Third Configuration Example

Figure 5:
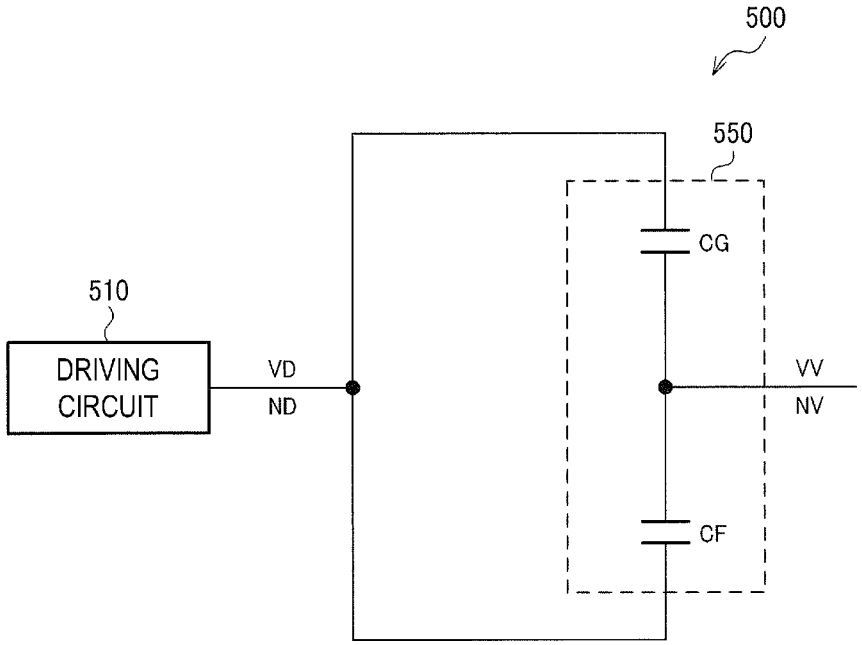
FIG. 5 is a block diagram illustrating a third configuration example of the circuit device.
Figure 6:
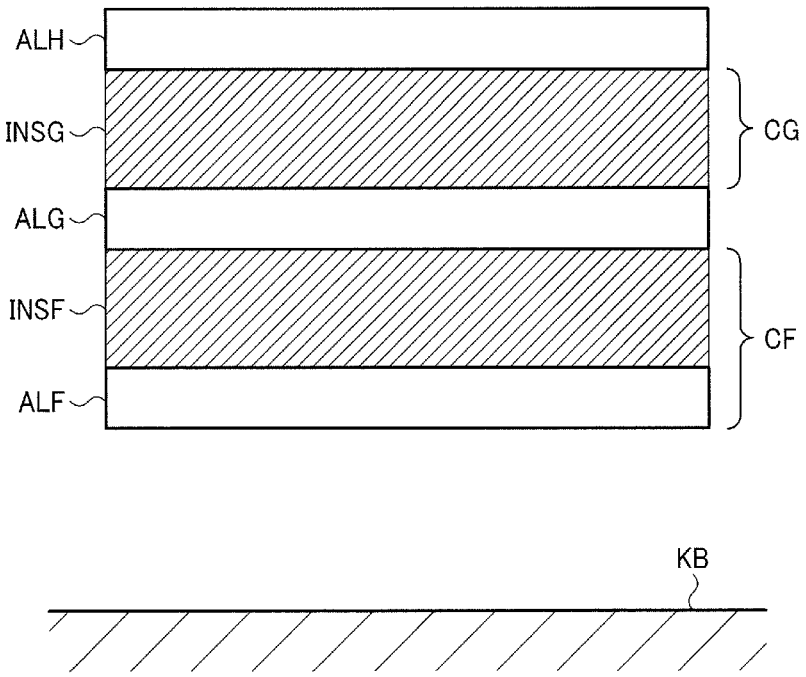
FIG. 6 is a cross-sectional view illustrating the structure of a capacitor in the third configuration example.

FIG. 5 is a block diagram illustrating a third configuration example of the circuit device 500. Further, FIG. 6 is a cross-sectional view illustrating the structure of a capacitor in the third configuration example. In the following, "the upper direction" is the thickness direction of the substrate KB and the direction away from the substrate KB in FIG. 6.

The output capacitor 550 includes a first capacitor element CF and a second capacitor element CG. These capacitor elements are coupled in parallel. In other words, one end of the first capacitor element CF and one end of the second capacitor element CG are coupled to the capacitor drive node ND and the other end of the first capacitor element CF and the other end of the second capacitor element CG are coupled to the voltage output node NV.

As illustrated in FIG. 6, the first capacitor element CF includes a 11th metal layer ALF, a 12th metal layer ALG, and a 11th insulating layer INSF. The 12th metal layer ALG is disposed above the 11th metal layer ALF. The 11th insulating layer INSF is provided between the 11th metal layer ALF and the 12th metal layer ALG. The second capacitor element CG includes the 12th metal layer ALG, a 13th metal layer ALH, and a 12th insulating layer INSG. The 13th metal layer ALH is disposed above the 12th metal layer ALG. The 12th insulating layer INSG is provided between the 12th metal layer ALG and the 13th metal layer ALH.

The metal layers ALF to ALH are metal wiring layers for forming wiring between circuit elements, and are, for example, aluminum layers. The insulating layers INSF and INSG are layers for establishing insulation between the metal layers, and are silicon oxide layers, for example. The metal layers ALF to ALH and the insulating layers INSF and INSG are stacked on the substrate KB by a semiconductor process. Note that the metal layer ALF is not limited to the bottom-most wiring layer, and a wiring layer may be further formed below the metal layer ALF.

The 11th metal layer ALF and the 13th metal layer ALH are electrically coupled to the capacitor drive node ND. Further, the 12th metal layer ALG is electrically coupled to the voltage output node NV.

The first capacitor element CF and the second capacitor element CG are arranged to be overlapped in plan view in the thickness direction of the substrate KB. In plan view, the areas of the 11th metal layer ALF and the 13th metal layer ALH are the same, and the entirety of the 11th metal layer ALF and the entirety of the 13th metal layer ALH are arranged to be overlapped.

According to the embodiment, the metal layer ALG to be coupled to the voltage output node NV is configured to be shielded by the metal layers ALF and ALH. As a result, formation of the capacitive coupling in relation to the metal layer ALF to be coupled to the voltage output node NV is suppressed, thus the parasitic capacitance in the voltage output node NV is reduced. As a result, accurate charge redistribution can be achieved between the output capacitor 550 and the capacitance CNV of the voltage output node NV, thus the circuit device 500 can output the accurate output voltage VV to the voltage output node NV.

In addition, according to the embodiment, in plan view in the thickness direction of the substrate KB, the first capacitor element CF and the second capacitor element CG are arranged to be overlapped. Since the first capacitor element CF and the second capacitor element CG are coupled in parallel, the capacitance value of the output capacitor 550 is the sum of the capacitance values of the two capacitor elements CF and CG. As a result, the area of the output capacitor 550 can be reduced in plan view in the thickness direction of the substrate KB.

4. Fourth Configuration Example

Figure 7:
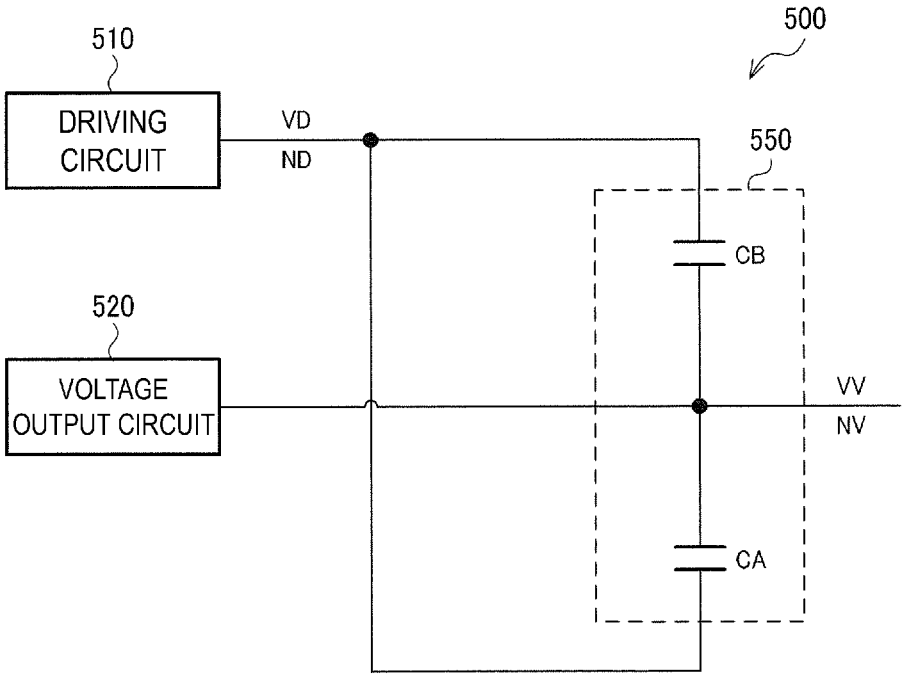
FIG. 7 is a block diagram illustrating a fourth configuration example of the circuit device.

FIG. 7 is a block diagram illustrating a fourth configuration example of the circuit device 500. In the fourth configuration example, the circuit device 500 includes a voltage output circuit 520. Note that the components that are the same as the components described in connection with FIG. 1 are referenced using like numbers, and descriptions for such components will be omitted as appropriate.

The voltage output circuit 520 outputs the output voltage VV to the voltage output node NV. In other words, the voltage output node NV is driven by the charge redistribution between the output capacitor 550 and the capacitance CNV of the voltage output node NV, and the voltage output node NV is also driven by the voltage output circuit 520. Specifically, as the driving circuit 510 changes the capacitor drive voltage VD, charge redistribution occurs between the output capacitor 550 and the capacitance CNV. As a result, the voltage of the voltage output node NV substantially reaches the target voltage. Further, the voltage output circuit 520 outputs a more accurate output voltage VV, as a result of which the voltage of the voltage output node NV becomes exactly equal to the output voltage VV. The voltage output circuit 520 is, for example, an amplifier circuit, a buffer circuit, or the like.

When the voltage of the voltage output node NV is desired to be changed at high speed by an amplifier circuit or the like, it is necessary for the amplifier circuit or the like to charge the capacitance CNV at high speed. Therefore, for example, it is necessary to increase the slew rate of the amplifier circuit, thus the power consumption or layout area of the amplifier circuit increases. According to the embodiment, charging the capacitance CNV by charge redistribution allows for the change in the voltage of the voltage output node NV at high speed. The voltage output circuit 520 only needs to drive the capacitance CNV that has been charged to approximately the target voltage, thus the high slew rate is not necessary.

Note that the structure of the output capacitor 550 in FIG. 7 is the structure illustrated in FIG. 2. The structure of the output capacitor 550 in FIG. 7 may be the structure illustrated in FIG. 4 or FIG. 6.

5. Display Driver

A display driver configured to drive an electro-optical panel, for example, is contemplated as the circuit device of the embodiment.

Figure 8:
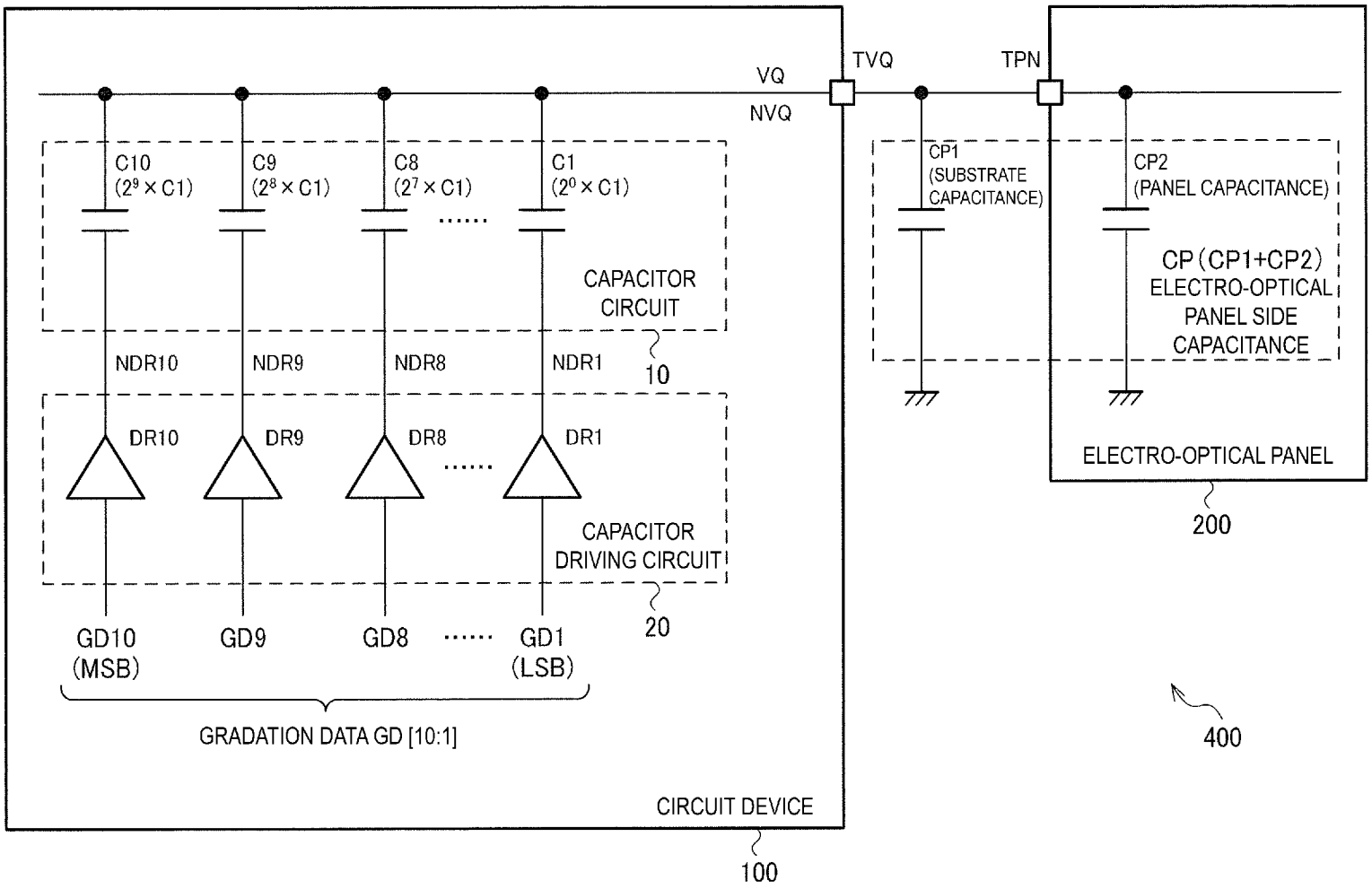
FIG. 8 is a first configuration example of a circuit device being a display driver.

FIG. 8 illustrates a first configuration example of a circuit device 100 being a display driver and a configuration example of an electro-optical device 400 including the circuit device 100. The electro-optical device 400 includes the circuit device 100 and an electro-optical panel 200. The circuit device 100 includes a capacitor circuit 10, a capacitor driving circuit 20, and a data voltage output terminal TVQ. Note that, in the following, when a capacitance value of a capacitor is indicated, the same sign as the sign of the capacitor will be used.

The circuit device 100 is, for example, an integrated circuit device. The data voltage output terminal TVQ is a pad provided on a semiconductor substrate or a terminal provided on a package of an integrated circuit device. The electro-optical panel 200 is, for example, a liquid crystal display panel, an electro luminescence (EL) panel, or the like.

The capacitor circuit 10 includes first to n-th capacitors C1 to Cn (where n is a natural number not less than 2). The capacitor driving circuit 20 includes first to n-th driving circuits DR1 to DRn. Note that, in the following, the case of n=10 is described as an example, but n may be a natural number not less than 2. For example, n may be set to the same number as the number of bits of the gradation data. The gradation data is display data. In the following, the gradation data for one pixel is described as GD [10:1].

One end of the i-th capacitor of the capacitors C1 to C10 is coupled to the capacitor drive node NDRi, and the other end of the i-th capacitor is coupled to the data voltage output node NVQ. i is a natural number equal to or less than n=10. The data voltage output node NVQ is a node to be coupled to the data voltage output terminal TVQ. The capacitors C1 to C10 each have a capacitance value weighted by a power of two. Specifically, the capacitance value of the i-th capacitor Ci is $2^{(i-1)}\times C1$.

The i-th driving circuit DRi of the first to tenth driving circuits DR1 to DR10 receives the i-th bit GDi of the gradation data GD [10:1] from the input node of the i-th driving circuit DRi. The output node of the i-th driving circuit DRi is the i-th capacitor drive node NDRi. The gradation data GD [10:1] includes first to tenth bits GD1 to GD10 with the bit GD1 corresponding to LSB and the bit GD10 corresponding to MSB.

The i-th driving circuit DRi outputs a first voltage level when the bit GDi is at a first logic level and outputs a second voltage level when the bit GDi is at a second logic level. For example, the first logic level is a low level, the second logic level is a high level, the first voltage level is the voltage of the low potential side power supply VSS, and the second voltage level is the voltage of the high potential side power supply VDD. For example, the i-th driving circuit DRi includes a level shifter configured to shift the input logic level to an output voltage level of the driving circuit DRi and a buffer circuit for buffering the output of the level shifter.

As described above, each of the capacitance values of the capacitors C1 to C10 is weighted by a power of two corresponding to each of the numbers of digits of the bits GD1 to GD10 of the gradation data GD [10:1]. Further, the driving circuits DR1 to DR10 outputs VSS or VDD based on the bits GD1 to GD10, respectively, as a result of which the capacitors C1 to C10 are driven by these voltages. The driving of the capacitors C1 to C10 causes charge redistribution between the capacitors C1 to C10 and the electro-optical panel side capacitance CP, and as a result, data voltage is output to the data voltage output terminal TVQ.

The electro-optical panel side capacitance CP is the total capacitance from the point of view of the data voltage output terminal TVQ. For example, the electro-optical panel side capacitance CP is a sum of the substrate capacitance CP1 being the parasitic capacitance of the printed circuit board, and the panel capacitance CP2 including the parasitic capacitance and the pixel capacitance in the electro-optical panel 200.

Specifically, the circuit device 100 is implemented on a rigid substrate to form an integrated circuit device, a flexible substrate is coupled to the rigid substrate, and the electro-optical panel 200 is coupled to the flexible substrate. The rigid substrate and the flexible substrate are provided with wiring for coupling the data voltage output terminal TVQ of the circuit device 100 with a data voltage input terminal TPN of the electro-optical panel 200. The parasitic capacitance in the wiring is the substrate capacitance CP1. The electro-optical panel 200 is provided with a data line coupled to the data voltage input terminal TPN, a source line, a switch element for coupling the data line with the source line, and a pixel circuit to be coupled to the source line. For example, the switch element may include a thin film transistor (TFT), which has parasitic capacitance between the source and gate. Since a large number of switch elements are coupled to the data line, the data line has a large number of parasitic capacitances derived from the switch elements. There is also parasitic capacitance between the data line or source line and the panel substrate. In addition, the liquid crystal pixels have capacitance in the liquid display panel. The panel capacitance CP2 is a sum of the capacitances.

The capacitance value of the electro-optical panel side capacitance CP is 50 pF to 120 pF, for example. As described below, a capacitance value of capacitance CO is 25 pF to 60 pF so that the ratio of the capacitance value of the capacitance CO of the capacitor circuit 10 to the electro-optical panel side capacitance CP is 1:2. Note that CO represents the sum of capacitances of the capacitors C1 to C10.

According to the embodiment, it is possible to output a data voltage corresponding to the gradation data GD [10:1] by capacitance driving resulting from charge redistribution between the capacitance CO of the capacitor circuit 10 and the electro-optical panel side capacitance CP. The driving by charge redistribution allows for settling at higher speed than amplifier driving in which the voltage is settled by using feedback control.

One or more of the capacitors C1 to C10 have a similar configuration to the output capacitor 550 illustrated in FIG. 1, etc. All of the capacitors C1 to C10 may have a similar configuration to the output capacitor 550, or only some of the capacitors C1 to C10 may have a similar configuration to the output capacitor 550. For example, among the capacitors C1 to C10, only capacitors corresponding to the most significant bit and following several bits, which have a large capacitance value, may have a similar configuration to the output capacitor 550. When the capacitor Ci is configured similarly to the output capacitor 550, the driving circuit DRi corresponds to the driving circuit 510 in FIG. 1, etc. In this case, the capacitor drive node NDRi corresponds to the capacitor drive node ND in FIG. 1, etc., and the data voltage output node NVQ corresponds to the voltage output node NV in FIG. 1, etc.

Figure 9:
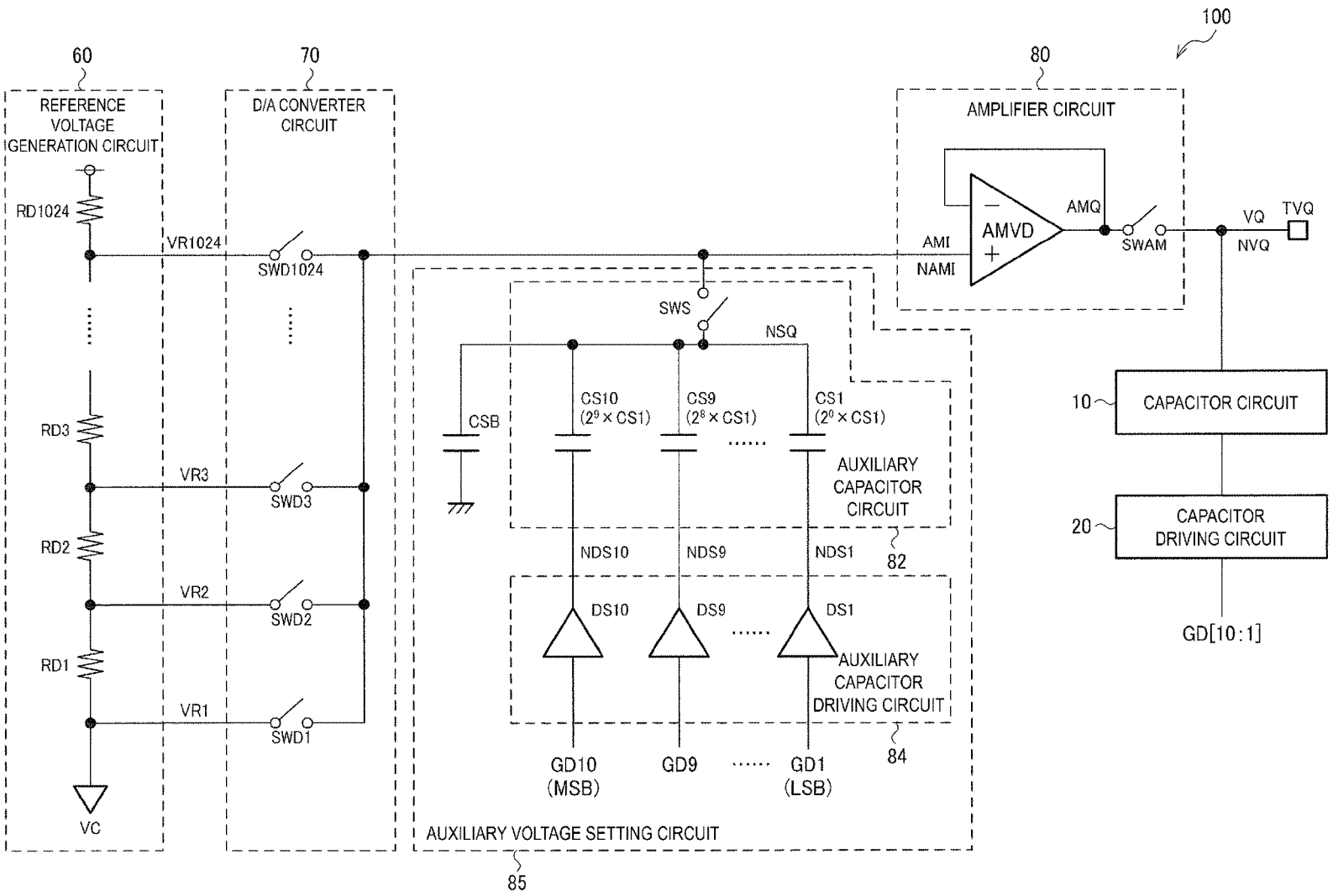
FIG. 9 is a second configuration example of the circuit device being a display driver.

FIG. 9 is a second configuration example of the circuit device 100 being a display driver. The circuit device 100 includes the capacitor circuit 10, the capacitor driving circuit 20, a reference voltage generation circuit 60, a D/A converter circuit 70, an amplifier circuit 80, an auxiliary voltage setting circuit 85, and the data voltage output terminal TVQ. Note that the capacitor circuit 10 and the capacitor driving circuit 20 are as illustrated in FIG. 8.

The auxiliary voltage setting circuit 85 is a circuit configured to set a voltage corresponding to the data voltage to an input node NAMI of the amplifier circuit 80. The data voltage is the voltage at the data voltage output terminal TVQ. Specifically, the auxiliary voltage setting circuit 85 includes an auxiliary capacitor circuit 82, an auxiliary capacitor driving circuit 84, and a balancing capacitor CSB.

The auxiliary capacitor circuit 82 includes first to n-th capacitors CS1 to CSn, a switch circuit SWS, and first to n-th driving circuits DS1 to DSn. Note that, in the following, a case where n=10 will be described as an example.

One end of the i-th capacitor CSi of the capacitors CS1 to CS10 is coupled to an auxiliary capacitor drive node NDSi, and the other end of the i-th capacitor CSi is coupled to a node NSQ. The capacitors CS1 to CS10 each have a capacitance value weighted by a power of two. Specifically, the capacitance value of the i-th capacitor CSi is $2^{(i-1)}\times CS1$.

The i-th bit GDi of the gradation data GD [10:1] is input to the input node of the i-th driving circuit DSi. The output node of the i-th driving circuit DSi is the i-th auxiliary capacitor drive node NDSi.

The i-th driving circuit DSi outputs a first voltage level when the bit GDi is at a first logic level and outputs a second voltage level when the bit GDi is at a second logic level. For example, the first logic level is a low level, the second logic level is a high level, the first voltage level is the voltage of the low potential side power supply VSS, and the second voltage level is the voltage of the high potential side power supply VDD. The i-th driving circuit DSi includes a level shifter configured to shift the input logic level to an output voltage level of the driving circuit DSi and a buffer circuit for buffering the output of the level shifter.

The switch circuit SWS is provided between the node NSQ to which the capacitors CS1 to CS10 is coupled and the input node NAMI of the amplifier circuit 80. The node NSQ and the node NAMI are coupled when the switch circuit SWS is turned on. The on/off control signal for the switch circuit SWS is supplied, for example, from a control circuit (not illustrated). A switch circuit SWAM may include, for example, a single switch element or may include a circuit including a plurality of switch elements. Alternatively, instead of the capacitors CS1 to CS10 being commonly coupled to the node NSQ, an individual switch element may be provided between each capacitor of the capacitors CS1 to CS10 and the node NAMI. The switch element is a transistor.

The one end of the balancing capacitor CSB is coupled to the node NSQ and the other end of the balancing capacitor CSB is coupled to the node of the low potential side power supply VSS. For example, the capacitance of the balancing capacitor CSB is set such that CSB'=2CSO (CSO=CS1+CS2+ . . . +CS10), where CSB' is the sum of the capacitance of the balancing capacitor CSB and the parasitic capacitance in the input node NAMI of the amplifier circuit 80. As a result, the voltage corresponding to the gradation data GD [10:1] is output to the node NAMI based on the same principle as the capacitance driving illustrated in FIG. 8. The parasitic capacitance in the node NAMI may be estimated, for example, based on process parameters or layout. Alternatively, the parasitic capacitance in the node NAMI may be estimated based on a simulation result.

Since an input voltage AMI for the amplifier circuit 80 is finally settled by the D/A converter circuit 70, the output of the auxiliary voltage setting circuit 85 and the output of the D/A converter circuit 70 need not to be exactly the same. Thus, it may be enough that CSB' is approximately equal to 2CS0.

The reference voltage generation circuit 60 is a circuit configured to generate a reference voltage corresponding to each value of the gradation data. For example, the reference voltage generation circuit 60 generates reference voltages VR1 to VR1024 for 1024 gradations corresponding to a 10 bit gradation data GD [10:1].

Specifically, the reference voltage generation circuit 60 includes first to 1024th resistive elements RD1 to RD1024 coupled in series between the high potential side power supply and the node of the common voltage VC. The first to 1024th reference voltages VR1 to VR1024 obtained by the voltage division are output from the taps of the resistive elements RD1 to RD1024, respectively.

The D/A converter circuit 70 is a circuit configured to select a reference voltage corresponding to the gradation data GD [10:1] from among the plurality of reference voltages from the reference voltage generation circuit 60. The selected reference voltage is output to the input node NAMI of the amplifier circuit 80 as the input voltage AMI.

Specifically, the D/A converter circuit 70 includes first to 1024th switch elements SWD1 to SWD1024, and one ends of the first to 1024th switch elements SWD1 to SWD1024 are supplied with the reference voltages VR1 to VR1024, respectively. The other ends of the switch elements SWD1 to SWD1024 are commonly coupled. Any one of the switch elements SWD1 to SWD1024 corresponding to the gradation data GD [10:1] is turned on, and the reference voltage supplied to the switch element is output as the voltage AMI. The on/off control signals for the switch elements SWD1 to SWD1024 are supplied, for example, from a control circuit (not illustrated). Alternatively, the D/A converter circuit 70 may have a decoder configured to decode the gradation data GD [10:1], and the gradation data GD [10:1] may be input to the decoder from a control circuit (not illustrated).

The amplifier circuit 80 amplifies the voltage AMI from the D/A converter circuit 70 and outputs the amplified voltage to the data voltage output terminal TVQ (voltage driving). The amplifier circuit 80 includes an operational amplifier AMVD and a switch circuit for voltage driving SWAM.

The operational amplifier AMVD has an operational amplifier circuit, which is configured, for example, as a voltage follower. The voltage AMI from the D/A converter circuit 70 is input to the input of the voltage follower.

The switch circuit for voltage driving SWAM is configured to couple or decouple the output of the operational amplifier AMVD to or from the data voltage output node NVQ. The switch circuit for voltage driving SWAM may, for example, include a single switch element or may include a circuit including a plurality of switch elements. The on/off control signal for the switch circuit for voltage driving SWAM is supplied, for example, from a control circuit (not illustrated).

Initially, during a first period, the switch circuit SWS is turned on and the switch circuit SWAM is turned off and the switch elements SWD1 to SWD1024 of the D/A converter circuit 70 are turned off. As the auxiliary voltage setting circuit 85 operates, the voltage at the node NAMI approaches the voltage corresponding to the gradation data GD [10:1]. During a second period following the first period, the switch circuit SWS is turned off, the switch circuit SWAM is turned on, and any one of the switch elements SWD1 to SWD1024 of the D/A converter circuit 70 is turned on based on the gradation data GD [10:1]. As a result, the D/A converter circuit 70 outputs a voltage corresponding to the gradation data GD [10:1] to the node NAMI, and the amplifier circuit 80 buffers the voltage and outputs the voltage to the data voltage output node NVQ.

One or more of the capacitors C1 to C10 of the capacitor circuit 10 have a similar configuration to the output capacitor 550 illustrated in FIG. 7. Alternatively, one or more of the capacitors CS1 to CS10 in the auxiliary capacitor circuit 82 have a similar configuration to the output capacitor 550 illustrated in FIG. 7.

When the capacitor Ci of the capacitor circuit 10 corresponds to the output capacitor 550, the driving circuit 510 corresponds to the driving circuit DRi, the voltage output circuit 520 corresponds to the amplifier circuit 80, the capacitor drive node ND corresponds to the capacitor drive node NDRi, and the voltage output node NV corresponds to the data voltage output node NVQ. All of the capacitors C1 to C10 may have a similar configuration to the output capacitor 550, or only some of the capacitors C1 to C10 may have a similar configuration to the output capacitor 550. When the capacitor CSi of the auxiliary capacitor circuit 82 corresponds to the output capacitor 550, the driving circuit 510 corresponds to the driving circuit DSi, the voltage output circuit 520 corresponds to the D/A converter circuit 70, the capacitor drive node ND corresponds to the auxiliary capacitor drive node NDSi, and the voltage output node NV corresponds to the node NSQ. All of the capacitors CS1 to CS10 may have a similar configuration to the output capacitor 550, or only some of the capacitors CS1 to CS10 may have a similar configuration to the output capacitor 550.

6. Examples of Layout Configuration

Examples of layout configurations of the capacitors according to the embodiment will be described using FIGS. 10 to 14.

Figure 10:
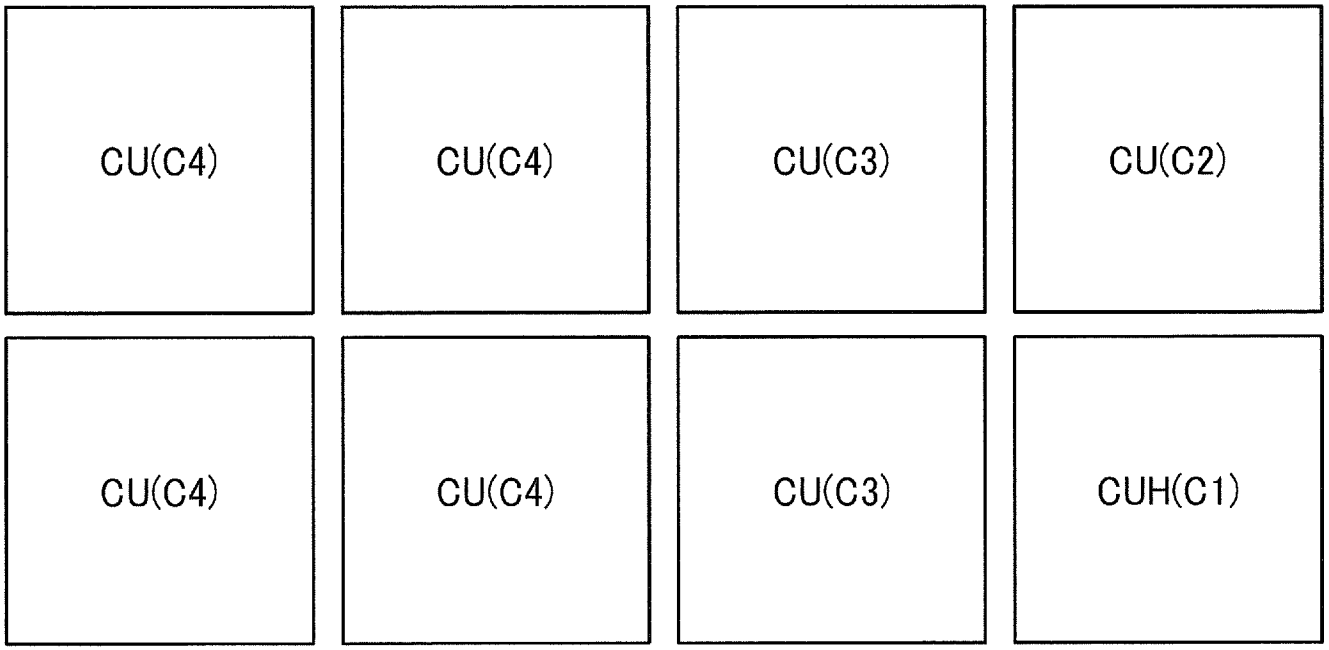
FIG. 10 is an example of a layout configuration of the capacitor.

FIG. 10 illustrates an example of a layout configuration of the capacitor circuit 10 of FIG. 8. In FIG. 10, n=4, C2 to C4 include two layer MIM capacitors, and C1 includes a single layer MIM capacitor. FIG. 10 illustrates an example of a layout configuration in plan view in the thickness direction of the substrate. D1 is the thickness direction of the substrate and the direction away from the substrate. The direction D1 is also referred to as "upper direction". D2 and D3 are directions parallel to the substrate plane and perpendicular to the direction D1. The directions D2 and D3 are perpendicular to each other.

As illustrated in FIG. 10, two rows and four columns of unit capacitors are arranged in plan view. In other words, four unit capacitor CUs are arranged along the direction D2, and adjacently to the four unit capacitor CUs in the direction D3, three unit capacitor CUs and one unit capacitor CUH are arranged. The unit capacitor CUs are two layer MIM capacitors and the unit capacitor CUH is a single layer MIM capacitor.

The capacitor C4 is formed by two rows and two columns of unit capacitor CUs, the capacitor C3 is formed by two rows and one column of unit capacitor CUs, the capacitor C2 is formed by one unit capacitor CU, and the capacitor C1 is formed by one unit capacitor CUH. As a result, the capacitors C1 to C4 with binary weighted capacitance values are realized. The metal layer corresponding to the voltage output node of each of the unit capacitors is commonly coupled to one wire. The wiring corresponds to the data voltage output node NVQ of FIG. 8.

Figure 11:
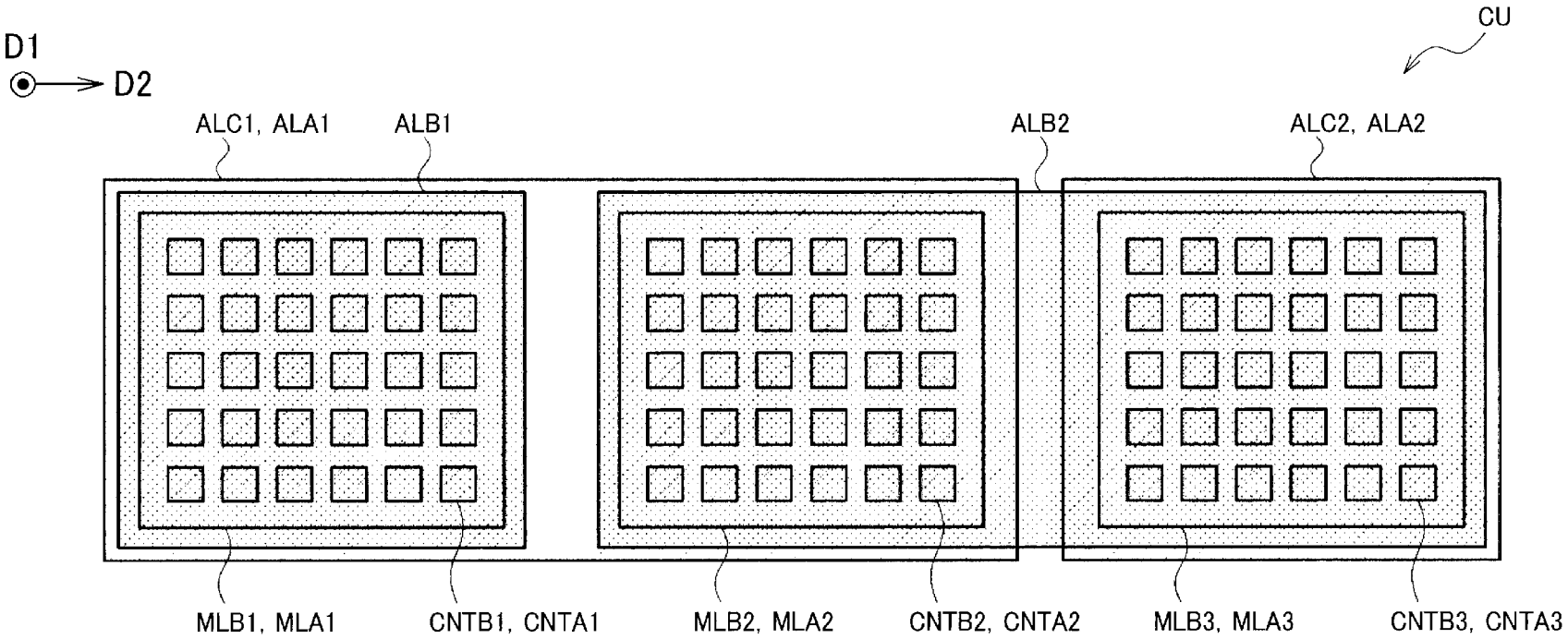
FIG. 11 is an example of a layout configuration of the capacitor.
Figure 12:
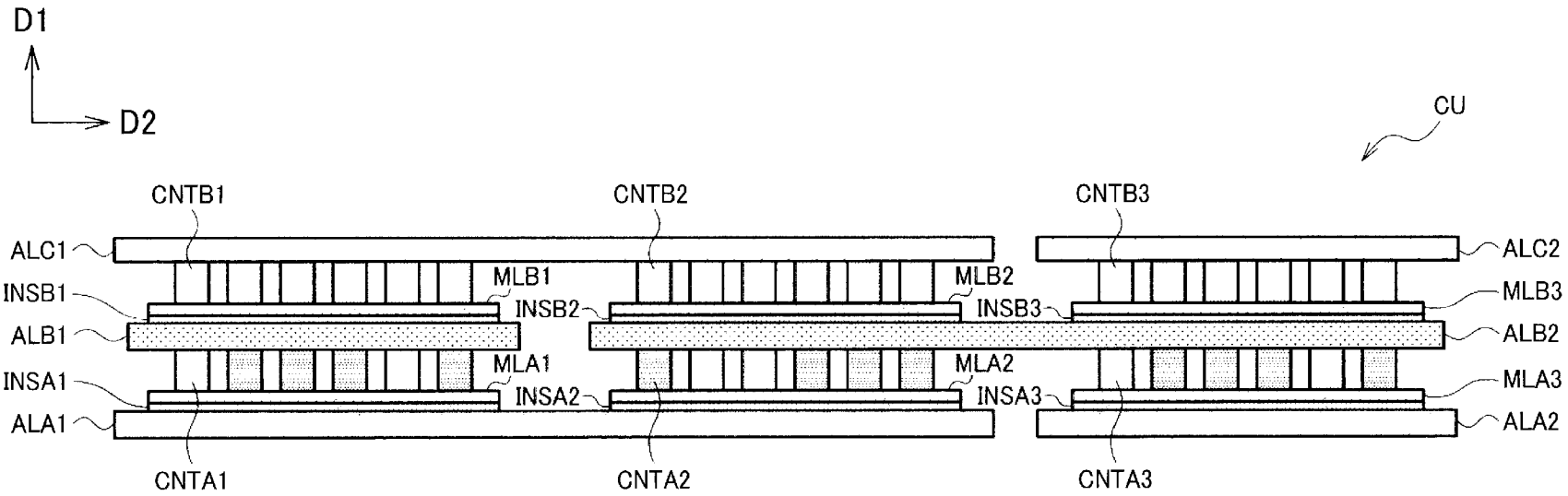
FIG. 12 is an example of a layout configuration of the capacitor.

FIGS. 11 and 12 illustrate an example of a layout configuration of the unit capacitor CU. FIG. 11 illustrates the thickness direction of the substrate in plan view. FIG. 12 illustrates a cross-sectional view in the direction D2.

Metal layers ALA1 and ALA2 are metal wiring layers in the same tier. The metal layer ALA1 and the metal layer ALA2 are arranged along the direction D2 in this order. Metal layers MLA1 to MLA3 are in the same tier, metal layers for forming the electrodes of the MIM capacitors, and disposed above the metal layers ALA1 and ALA2. The metal layers MLA1 to MLA3 are provided along the direction D2. Metal layers ALB1 and ALB2 are metal wiring layers in the same tier, and disposed above the metal layers MLA1 to MLA3. The metal layer ALB1 and the metal layer ALB2 are arranged along the direction D2 in this order. Metal layers MLB1 to MLB3 are in the same tier, metal layers for forming the electrodes of the MIM capacitors, and disposed above the metal layers ALB1 and ALB2. The metal layers MLB1 to MLB3 is provided along the direction D2. Metal layers ALC1 and ALC2 are metal wiring layers in the same tier, and are disposed above the metal layers MLB1 to MLB3. The metal layer ALC1 and the metal layer ALC2 are arranged along the direction D2 in this order.

In plan view, the metal layer ALA1 and the metal layer ALC1 are overlapped, and the metal layer ALA2 and the metal layer ALC2 are overlapped. The metal layer ALB2 is provided between the metal layer ALA1 and the metal layer ALC1. Approximately half of the metal layer ALB2 is provided between the metal layer ALA1 and the metal layer ALC1, and the remaining approximately half of the metal layer ALB2 is provided between the metal layer ALA2 and the metal layer ALC2.

The metal layer MLA1 is provided between the metal layer ALA1 and the metal layer ALB1, and is coupled to the metal layer ALB1 by a group of contacts CNTA1. An insulating layer INSA1 is provided between the metal layer MLA1 and the metal layer ALA1. The metal layer MLA2 is provided between the metal layer ALA1 and the metal layer ALB2, and is coupled to the metal layer ALB2 by a group of contacts CNTA2. An insulating layer INSA2 is provided between the metal layer MLA2 and the metal layer ALA1. The metal layer MLA3 is provided between the metal layer ALA2 and the metal layer ALB2, and is coupled to the metal layer ALB2 by a group of contacts CNTA3. An insulating layer INSA3 is provided between the metal layer MLA3 and the metal layer ALA2.

The metal layer MLB1 is provided between the metal layer ALB1 and the metal layer ALC1, and is coupled to the metal layer ALC1 by a group of contacts CNTB1. An insulating layer INSB1 is provided between the metal layer MLB1 and the metal layer ALB1. The metal layer MLB2 is provided between the metal layer ALB2 and the metal layer ALC1, and is coupled to the metal layer ALC1 by a group of contacts CNTB2. An insulating layer INSB2 is provided between the metal layer MLB2 and the metal layer ALB2. The metal layer MLB3 is provided between the metal layer ALB2 and the metal layer ALC2, and is coupled to the metal layer ALC2 by a group of contacts CNTB3. An insulating layer INSB3 is provided between the metal layer MLB3 and the metal layer ALB2.

When the unit capacitor CU of FIGS. 11 and 12 forms the capacitor Ci of FIG. 8, the metal layers ALA1, ALA2, ALC1, and ALC2 are coupled to the capacitor drive node NDRi of FIG. 8. Further, the metal layers ALB1 and ALB2 are coupled to the data voltage output node NVQ of FIG. 8.

Figure 13:
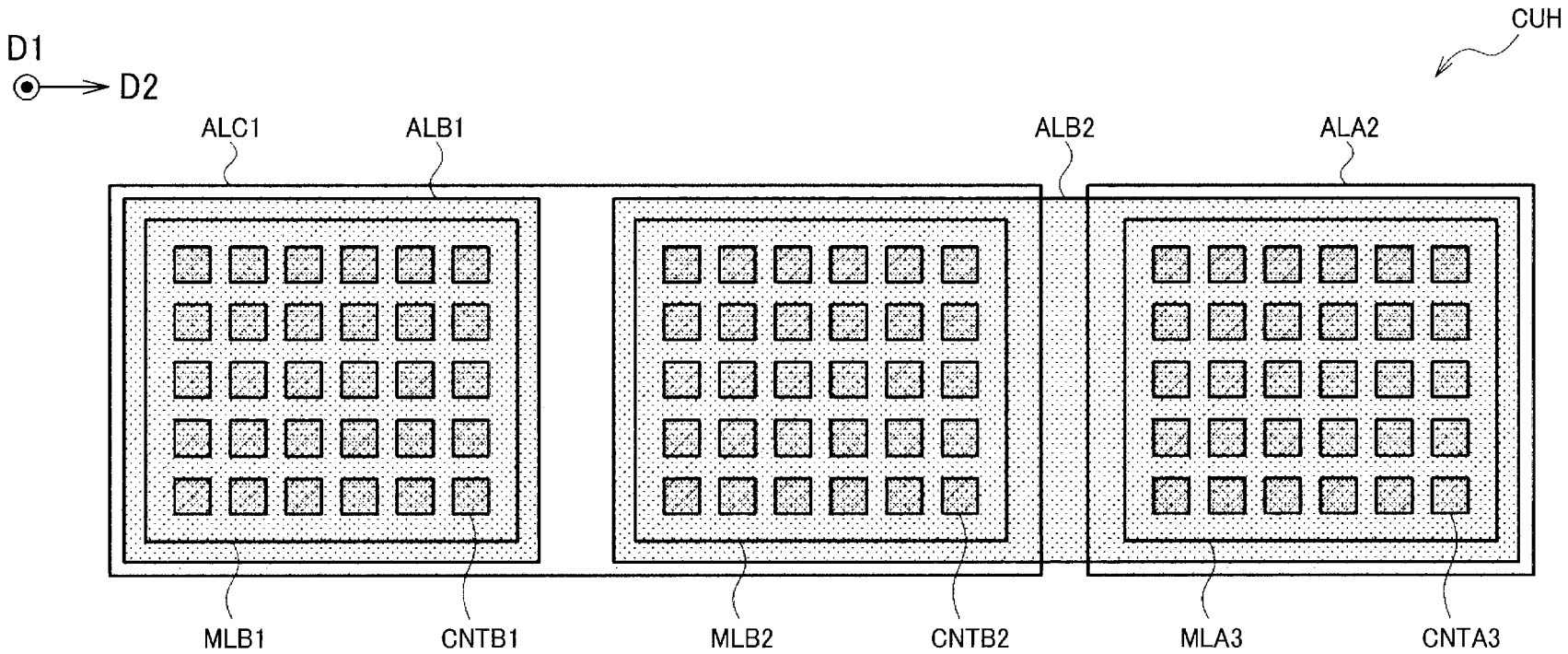
FIG. 13 is an example of a layout configuration of the capacitor.
Figure 14:
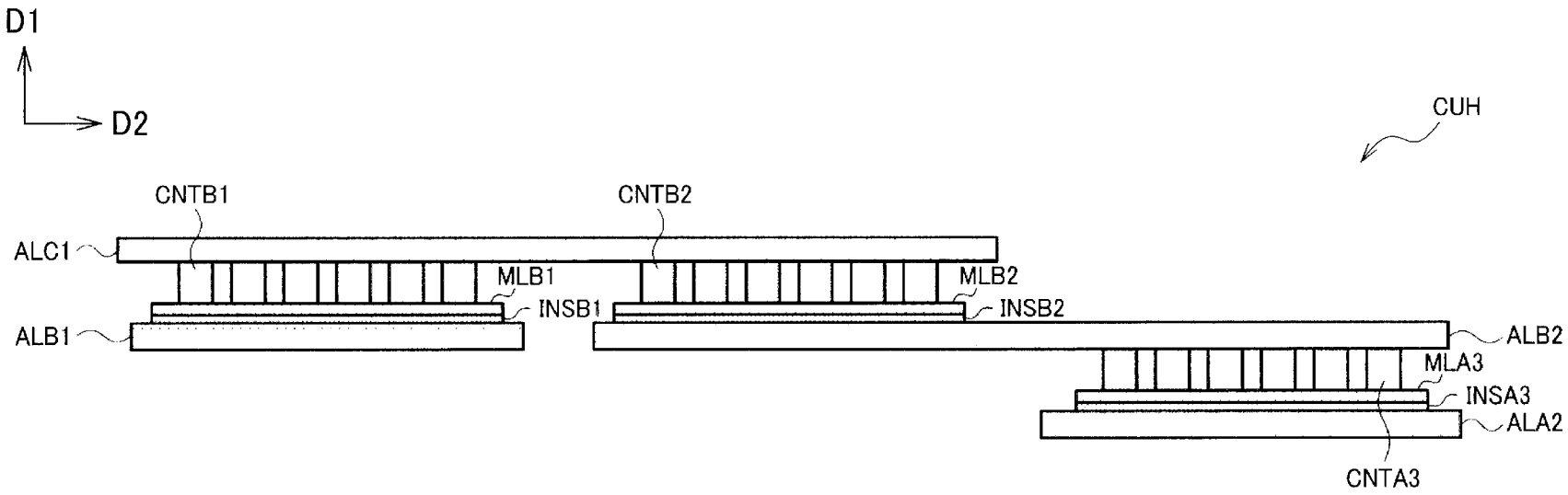
FIG. 14 is an example of a layout configuration of the capacitor.

FIGS. 13 and 14 illustrate an example of a layout configuration of the unit capacitor CUH. FIG. 13 illustrates the thickness direction of the substrate in plan view. FIG. 14 illustrates a cross-sectional view in the direction D2.

The unit capacitor CUH is obtained by modifying the unit capacitor CU, which is the two layer MIM capacitor, to be a single layer MIM capacitor. Specifically, the unit capacitor CUH is the unit capacitor CU of FIGS. 11 and 12, in which the metal layers ALA1, MLA1, MLA2, ALC2, MLB3, the groups of contacts CNTA1, CNTA2, CNTB3, as well as the insulating layers INSA1, INSA2, and INSB3 are removed. As a result, the capacitance value of the unit capacitor CUH is half the capacitance value of the unit capacitor CU.

When the unit capacitor CUH of FIGS. 13 and 14 forms the capacitor Ci of FIG. 8, the metal layers ALA2 and ALC1 are coupled to the capacitor drive node NDRi of FIG. 8. Further, the metal layers ALB1 and ALB2 are coupled to the data voltage output node NVQ of FIG. 8.

7. Electronic Apparatus

Figure 15:
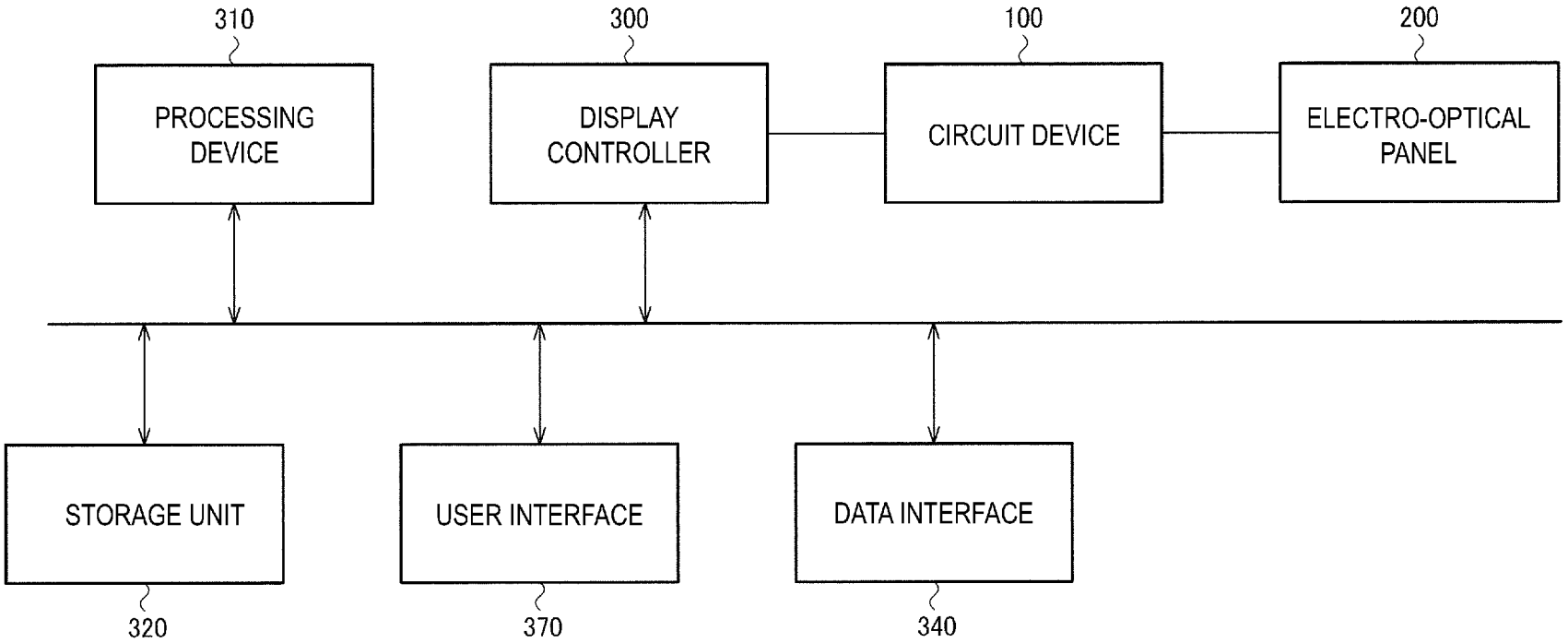
FIG. 15 is a configuration example of an electronic apparatus.

FIG. 15 illustrates a configuration example of an electronic apparatus to which the circuit device 100 may be applied. Various electronic apparatus on which display devices are mounted can be contemplated as the electronic apparatus of the embodiment. Contemplated examples of the electronic apparatus include a projector or a television device, an information processing device, a personal digital assistant, a car navigation system, a portable game terminal, and the like.

The electronic apparatus illustrated in FIG. 15 includes the circuit device 100, the electro-optical panel 200, a display controller 300, a processing device 310, a storage unit 320, a user interface 330, and a data interface 340.

The electro-optical panel 200 is, for example, a matrix type liquid crystal display panel. Alternatively, the electro-optical panel 200 may be an electro luminescence (EL) display panel using self-luminous elements. The user interface 330 is an interface unit for receiving various operations from a user. For example, the user interface 330 includes a button or a mouse, a keyboard, and a touch panel mounted to the electro-optical panel 200. The data interface 340 is an interface unit for inputting and outputting image data and control data. For example, the data interface 340 is a wired communication interface such as a USB or a wireless communication interface such as a wireless LAN. The storage unit 320 stores image data input from the data interface 340. Alternatively, the storage unit 320 serves as a working memory for the processing device 310 or the display controller 300. The processing device 310 performs control processing for the units in the electronic apparatus and various data processing. The processing device 310 is a processor such as a central processing unit (CPU). The display controller 300 performs control processing for the circuit device 100. For example, the display controller 300 converts image data transferred from the data interface 340 or the storage unit 320 into a format receivable in the circuit device 100, and outputs the converted image data to the circuit device 100. The circuit device 100 drives the electro-optical panel 200 based on the image data transferred from the display controller 300.

According to the above embodiment, the circuit device includes a driving circuit configured to output a capacitor drive voltage to the capacitor drive node, and an output capacitor provided between the capacitor drive node and the voltage output node. The output capacitor includes a first MIM capacitor element and a second MIM capacitor element. The first MIM capacitor element includes a first metal layer, a second metal layer disposed above the first metal layer, and a first insulating layer provided between the first metal layer and the second metal layer. The second MIM capacitor element includes a third metal layer disposed above the second metal layer, a fourth metal layer disposed above the third metal layer, and a second insulating layer provided between the third metal layer and the fourth metal layer. The first metal layer and the fourth metal layer are electrically coupled to the capacitor drive node. The second metal layer and the third metal layer are electrically coupled to the voltage output node.

According to the embodiment, the first MIM capacitor element includes the second metal layer to be coupled to the voltage output node and the first metal layer provided below the second metal layer. The second MIM capacitor element includes the third metal layer to be coupled to the voltage output node and the fourth metal layer provided above the third metal layer. Thus, the second metal layer and the third metal layer to be coupled to the voltage output node are configured to be shielded by the first metal layer and the fourth metal layer. As a result, formation of the capacitive coupling in relation to the second metal layer and the third metal layer to be coupled to the voltage output node is suppressed, and thus, the parasitic capacitance in the voltage output node is reduced. Therefore, accurate charge redistribution can be achieved between the output capacitor and capacitance to be coupled to the voltage output node, thus the circuit device can output the accurate output voltage to the voltage output node.

Further, in the embodiment, the output capacitor may include a third MIM capacitor element and a fourth MIM capacitor element. The third MIM capacitor element may include a fifth metal layer disposed above the fourth metal layer, a sixth metal layer disposed above the fifth metal layer, and a third insulating layer provided between the fifth metal layer and the sixth metal layer. The fourth MIM capacitor element may include a seventh metal layer disposed above the sixth metal layer, an eighth metal layer disposed above the seventh metal layer, and a fourth insulating layer provided between the seventh metal layer and the eighth metal layer. The fifth metal layer and the eighth metal layer may be electrically coupled to the capacitor drive node. The sixth metal layer and the seventh metal layer may be electrically coupled to the voltage output node.

According to the embodiment, the sixth metal layer and the seventh metal layer to be coupled to the voltage output node are configured to be shielded by the fifth metal layer and the eighth metal layer. As a result, formation of the capacitive coupling in relation to the sixth metal layer and the seventh metal layer to be coupled to the voltage output node is suppressed, thus the parasitic capacitance in the voltage output node is reduced.

Further, in the embodiment, the capacitor drive voltage may be a voltage based on gradation data.

According to the embodiment, the driving circuit outputs the capacitor drive voltage based on a gradation voltage so that the voltage corresponding to the gradation data is output to the voltage output node. In the embodiment, one end of the output capacitor is coupled to the voltage output node, and the parasitic capacitance generated at the one end of the output capacitor is reduced. As a result, a deviation in the capacitance ratio in the charge redistribution is reduced, thus accurate voltage corresponding to the gradation data is output.

Further, in the embodiment, the first MIM capacitor element and the second MIM capacitor element may be arranged to be overlapped in plan view in the thickness direction of the substrate of the circuit device.

Since the first MIM capacitor element and the second MIM capacitor element are coupled in parallel, the capacitance value of the output capacitor is the sum of the capacitance values of the two MIM capacitor elements. Thus, according to the embodiment, in plan view in the thickness direction of the substrate, the capacitance value per area is doubled. As a result, it is possible to reduce the layout area of the output capacitor.

Further, in the embodiment, the circuit device may include a plurality of capacitors. Each of the capacitors may be the output capacitor described above. One ends of the plurality of capacitors may be commonly coupled to the voltage output node.

According to the embodiment, when the circuit device includes a plurality of capacitors, the layout area of the plurality of capacitors can be reduced. Additionally, the parasitic capacitance in the voltage output node to which one ends of the plurality of capacitors are commonly coupled can be reduced, thus accurate voltage will be output to the voltage output node.

Further, in the embodiment, an electro-optical panel may be driven by charge redistribution between the plurality of capacitors and electro-optical panel side capacitance.

According to the embodiment, the parasitic capacitance in the voltage output node to which the one ends of the plurality of capacitors are commonly coupled can be reduced, thus the accurate capacitance ratio between the plurality of capacitors and the electro-optical panel side capacitance is archived. As a result, accurate charge redistribution between the plurality of capacitors and the electro-optical panel side capacitance can be achieved, and the electro-optical panel can be driven with accurate voltage.

Further, in the embodiment, the circuit device may include a D/A converter circuit configured to output gradation voltage to the voltage output node, and an amplifier circuit coupled to the voltage output node and configured to drive an electro-optical panel.

According to the embodiment, driving by charge redistribution and driving by the amplifier circuit can be combined. For example, the driving by the amplifier circuit can be performed after the driving by charge redistribution. Since charges are supplied to pixel capacitance by charge redistribution, the charge amount to be supplied by the amplifier circuit is reduced. As a result, the writing to the pixels can be performed more rapidly, and the power consumption of the amplifier circuit can be reduced.

Further, in the embodiment, the circuit device includes a capacitor driving circuit configured to output a capacitor drive voltage to the capacitor drive node, and an output capacitor provided between the capacitor drive node and the voltage output node. The output capacitor includes a first capacitor element and a second capacitor element. The first capacitor element includes a first metal layer, a second metal layer disposed above the first metal layer, and a first insulating layer provided between the first metal layer and the second metal layer. The second capacitor element includes a second metal layer, a third metal layer disposed above the second metal layer, and a second insulating layer provided between the second metal layer and the third metal layer. The first metal layer and the third metal layer are electrically coupled to the capacitor drive node. The second metal layer is electrically coupled to the voltage output node.

According to the embodiment, the first capacitor element includes the second metal layer to be coupled to the voltage output node and the first metal layer provided below the second metal layer. Further, the second capacitor element includes the second metal layer to be coupled to the voltage output node and the third metal layer provided above the second metal layer. Thus, the second metal layer to be coupled to the voltage output node are configured to be shielded by the first metal layer and the third metal layer. As a result, formation of the capacitive coupling in relation to the second metal layer to be coupled to the voltage output node is suppressed, thus the parasitic capacitance in the voltage output node is reduced. As a result, accurate charge redistribution can be achieved between the output capacitor and capacitance to be coupled to the voltage output node, thus the circuit device can output the accurate output voltage to the voltage output node.

In the embodiment, the electro-optical device may include any one of the above-described circuit devices and an electro-optical panel driven by the circuit device.

Further, in the embodiment, the electronic apparatus may include any one of the above-described circuit devices.

Although the embodiment has been described in detail above, those skilled in the art will easily understand that many modified examples can be made without substantially departing from the novel matter and effects of the present disclosure. All such modified examples are thus included in the scope of the present disclosure. For example, terms in the descriptions or drawings given even once along with different terms having identical or broader meanings can be replaced with those different terms in all parts of the descriptions or drawings. All combinations of the embodiment and modified examples are also included within the scope of the present disclosure. Furthermore, the configurations, operations, and the like of the circuit device, the electro-optical device, the electronic apparatus, and the like are not limited to those described in the embodiment, and various modifications thereof are possible.

What is claimed is:

1. A circuit device comprising:

a driving circuit configured to output a capacitor drive voltage to a capacitor drive node; and an output capacitor, one end of the output capacitor being electrically coupled to the capacitor drive node and the other end of the output capacitor being electrically coupled to a voltage output node, wherein the output capacitor includes a first MIM capacitor element including a first metal layer, a second metal layer, and a first insulating layer provided between the first metal layer and the second metal layer, and a second MIM capacitor element including a third metal layer, a fourth metal layer, and a second insulating layer provided between the third metal layer and the fourth metal layer, the first metal layer and the fourth metal layer are directly electrically coupled to the capacitor drive node, the second metal layer and the third metal layer are directly electrically coupled to the voltage output node, each of the second metal layer and the third metal layer is positioned between the first metal layer and the fourth metal layer, and each of an outside of the first metal layer and an outside of the fourth metal layer does not include any MIM capacitor element electrically coupled to the first metal layer and the fourth metal layer.

2. The circuit device according to claim 1, wherein the capacitor drive voltage is a voltage based on gradation data.

3. The circuit device according to claim 1, wherein the first MIM capacitor element and the second MIM capacitor element are arranged to overlap in plan view in a thickness direction of a substrate of the circuit device.

4. The circuit device according to claim 1, wherein the output capacitor comprises a plurality of capacitors, and each end of the plurality of capacitors are commonly coupled to the voltage output node.

5. The circuit device according to claim 4, wherein the circuit device is configured to drive an electro-optical panel by charge redistribution between the plurality of capacitors and an electro-optical panel side capacitance.

6. The circuit device according to claim 4, comprising:

a D/A converter circuit configured to output a gradation voltage to the voltage output node; and an amplifier circuit coupled to the voltage output node and configured to drive an electro-optical panel.

7. An electro-optical device, comprising:

the circuit device according to claim 1; and an electro-optical panel configured to be driven by the circuit device.

8. An electronic apparatus, comprising the circuit device according to claim 1.

9. The circuit device according to claim 1, wherein no MIM capacitor elements are disposed between the second metal layer and the third metal layer.

10. A circuit device comprising:

a driving circuit configured to output a capacitor drive voltage to a capacitor drive node; and an output capacitor, one end of the output capacitor being electrically coupled to the capacitor drive node and the other end of the output capacitor being electrically coupled to a voltage output node, wherein the output capacitor includes:

a first MIM capacitor element including a first metal layer, a second metal layer, and a first insulating layer provided between the first metal layer and the second metal layer, a second MIM capacitor element including a third metal layer, a fourth metal layer, and a second insulating layer provided between the third metal layer and the fourth metal layer, a third MIM capacitor element including a fifth metal layer, a sixth metal layer, and a third insulating layer provided between the fifth metal layer and the sixth metal layer, and a fourth MIM capacitor element including a seventh metal layer, an eighth metal layer, and a fourth insulating layer provided between the seventh metal layer and the eighth metal layer, the first metal layer, the fourth metal layer, the fifth metal layer and the eighth metal layer are electrically coupled to the capacitor drive node, the second metal layer, the third metal layer, the sixth metal layer and the seventh metal layer are electrically coupled to the voltage output node, the second metal layer and the third metal layer are disposed between the first metal layer and the fourth metal layer, and the sixth metal layer and the seventh metal layer are disposed between the fifth metal layer and the eighth metal layer.

11. An electronic apparatus, comprising the circuit device according to claim 10.

12. A circuit device comprising:

a driving circuit configured to output a capacitor drive voltage corresponding to gradation data to a capacitor drive node; and an output capacitor, one end of the output capacitor being electrically coupled to the capacitor drive node and the other end of the output capacitor being electrically coupled to a voltage output node outputting an output voltage corresponding to the gradation data based on the capacitor drive voltage, wherein the output capacitor includes a first capacitor element including a first metal layer, a second metal layer, and a first insulating layer provided between the first metal layer and the second metal layer, and a second capacitor element including the second metal layer, a third metal layer, and a second insulating layer provided between the second metal layer and the third metal layer, the first metal layer and the third metal layer are electrically coupled to the capacitor drive node, the second metal layer is electrically coupled to the voltage output node, the second metal layer is positioned between the first metal layer and the third metal layer, and each of an outside of the first metal layer and an outside of the third metal layer does not include any capacitor element electrically coupled to the first metal layer and the third metal layer.

13. An electro-optical device, comprising:

the circuit device according to claim 12; and an electro-optical panel configured to be driven by the circuit device.

14. An electronic apparatus, comprising the circuit device according to claim 12.

* * * * *